US008319767B2

(12) United States Patent
Hiratsuka

(10) Patent No.: US 8,319,767 B2
(45) Date of Patent: Nov. 27, 2012

(54) DISPLAY DRIVER INCLUDING PLURALITY OF AMPLIFIER CIRCUITS RECEIVING DELAYED CONTROL SIGNAL AND DISPLAY DEVICE

(75) Inventor: Hitoshi Hiratsuka, Shiga (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 330 days.

(21) Appl. No.: 12/654,876

(22) Filed: Jan. 7, 2010

(65) Prior Publication Data

US 2010/0194731 A1 Aug. 5, 2010

(30) Foreign Application Priority Data

Feb. 2, 2009 (JP) ..... 2009-021541

(51) Int. Cl.
*G09G 3/36* (2006.01)

(52) U.S. Cl. ..... 345/208; 345/99

(58) Field of Classification Search ..... 345/98–100, 345/208; 327/269

See application file for complete search history.

(56) References Cited

U.S. PATENT DOCUMENTS

| | | | | |
|---|---|---|---|---|
| 5,489,867 | A | 2/1996 | Tamanoi | |
| 7,002,544 | B2 * | 2/2006 | Sekido | 345/100 |
| 2005/0046647 | A1 | 3/2005 | Lee | |
| 2005/0264548 | A1 * | 12/2005 | Okamura et al. | 345/204 |

FOREIGN PATENT DOCUMENTS

| | | |
|---|---|---|
| JP | 7-13509 | 1/1995 |
| JP | 2003-233358 | 8/2003 |
| JP | 2005-078096 A | 3/2005 |

OTHER PUBLICATIONS

Japanese Notification of Reasons for Refusal dated Sep. 11, 2012, with English-language translation.

* cited by examiner

*Primary Examiner* — Chanh Nguyen
*Assistant Examiner* — Allison Walthall
(74) *Attorney, Agent, or Firm* — McGinn IP Law Group, PLLC

(57) ABSTRACT

A driver includes a plurality of amplifier circuits which outputs a plurality of gradation voltages to a display portion according to a control signal, a control circuit which outputs the control signal, and a delay portion which sequentially supplies the control signal to amplifier circuits in a first amplifier circuit group, and which sequentially supplies a delayed control signal to amplifier circuits in a second amplifier circuit group other than the first amplifier circuit group, the delayed control signals obtained by delaying the control signal by a certain delay time.

7 Claims, 10 Drawing Sheets

DISPLAY DRIVER INCLUDING PLURALITY OF AMPLIFIER CIRCUITS RECEIVING DELAYED CONTROL SIGNAL AND DISPLAY DEVICE

INCORPORATION BY REFERENCE

This application is based upon and claims the benefit of priority from Japanese Patent Application No. 2009-021541 which was filed on Feb. 2, 2009, the disclosure of which is incorporated herein in its entirety by reference.

BACKGROUND OF THE INVENTION

1. Field of the Invention

The present invention relates to a driver (source driver) for driving an amplifier circuit and a TFT (Thin Film Transistor) liquid crystal display device applied thereto.

2. Description of Related Art

TFT (Thin Film Transistor) liquid crystal display devices have been widely used. A TFT liquid crystal display device includes a display portion (liquid crystal panel) that contains an LCD (Liquid Crystal Display) module, a gate driver, multiple source drivers, multiple gate lines connected to the gate driver and multiple data lines connected to each of the multiple source drivers. Each of the multiple gate lines is connected to gate electrodes of TFTs in pixels provided in a row. Each of the multiple data lines is connected to drain electrodes of the TFTs in the pixels provided in a column.

The source driver latches multiple display data from outside and performs digital/analog conversion on the multiple display data. Specifically, the source driver selects an output gradation voltage corresponding to the display data from multiple gradation voltages. The source driver includes an output amplifier for outputting the output gradation voltages to the multiple data lines.

The output amplifier includes multiple amplifier circuits. The multiple amplifier circuits have their outputs connected to the multiple data lines, respectively. Moreover, the multiple amplifier circuits operate according to control signals. The multiple amplifier circuits output the output gradation voltages to the multiple data lines according to the control signals, respectively.

In the TFT liquid crystal display device, it is preferable not to operate the multiple amplifier circuits at the same time. If the multiple amplifier circuits operate at the same timing, then a large current flows in a concentrated manner through the source driver. Thus, noise is caused in a power supply line and signal lines in a liquid crystal module. In order to reduce the noise, operation timings of the amplifier circuits need to be shifted from each other.

FIG. 1 shows a configuration of a source driver in a TFT liquid crystal display device described in Patent Document 1. The source driver further includes an amplifier circuit driving portion. The amplifier circuit driving portion includes a control circuit for outputting the control signals described above and delay circuits 141-1 to 141-(N−1) connected in series.

Here, it is assumed that the multiple data lines are N data lines provided from the first to Nth in this order, and that the multiple amplifier circuits are N amplifier circuits provided from the first to Nth in this order. It is also assumed that N is an integer of 4 or more and is a multiple of 2. In Patent Document 1, the N amplifier circuits will be hereinafter referred to as amplifier circuits 136-1 to 136-N, respectively.

An input of the delay circuit 141-1 is connected to the control circuit and the amplifier circuit 136-1. Outputs of the delay circuits 141-1 to 141-(N−1) are connected to the amplifier circuits 136-2 to 136-N, respectively.

FIG. 2 is a timing chart showing an operation of the amplifier circuit driving portion in the source driver shown in FIG. 1.

The control circuit outputs the control signal to the amplifier circuit 136-1. The delay circuits 141-1 to 141-(N−1) delay the control signals by a certain delay time in the order from the second to Nth, and then output the resultant control signals to the amplifier circuits 136-2 to 136-N, respectively.

FIG. 3 shows a configuration of a source driver in a TFT liquid crystal display device described in Patent Document 2. An amplifier circuit driving portion includes a control circuit for outputting the control signals and delay circuits 241-1 to 241-((N/2)−1) connected in parallel.

In Patent Document 2, N amplifier circuits will be hereinafter referred to as amplifier circuits 236-1 to 236-N, respectively.

An input of the delay circuit 241-1 and an input of the delay circuit 241-N are connected to the control circuit and the amplifier circuit 236-1. Outputs of the delay circuits 241-1 to 241-((N/2)−1) are respectively connected to the amplifier circuits 236-2 to 236-(N/2) and also respectively connected to the amplifier circuits 236-(N−1) to 236-((N/2)+1).

FIG. 4 is a timing chart showing an operation of an amplifier circuit driving portion in the source driver shown in FIG. 3.

The control circuit outputs the control signals to the amplifier circuits 236-1 and 236-N.

The delay circuits 241-1 to 241-((N/2)−1) delay the control signals by a certain delay time in the order from the second to (N/2)th, and then output the resultant control signals respectively to the amplifier circuits 136-2 to 136-(N/2) and respectively to the amplifier circuits 36-(N−1) to 36-((N/2)+1).

[Patent Document 1] Japanese Patent Application Laid Open No. 2003-233358

[Patent Document 2] Japanese Patent Application Laid Open No. Hei 7-13509

SUMMARY

The TFT liquid crystal display device described in Patent Document 1 has a problem (first problem) that there is a large difference between operation timings of the amplifier circuits.

A reason for the first problem will be described by taking, as an example, first and second source drivers among the multiple source drivers. Here, as described above, the amplifier circuits 136-1 to 136-N are provided in the order from the first to Nth. Thus, the amplifier circuit 136-N in the first source driver and the amplifier circuit 136-1 in the second source driver are assumed to be adjacent to each other.

The amplifier circuit driving portion outputs the control signals, in the order from the first to the Nth, respectively to the amplifier circuits 136-1 to 136-N in the first source driver and respectively to the amplifier circuits 136-1 to 136-N in the second source driver. In this case, the amplifier circuits 136-1 to 136-N in the first source driver operate in the order from the first to the Nth, and the amplifier circuits 136-1 to 136-N in the second source driver operate in the order from the first to the Nth. However, in each of the first and second source drivers, a time difference is large between a timing when the amplifier circuit 136-1 operates and a timing when the amplifier circuit 136-N operates. Thus, the excessively large time difference may cause abnormal display of vertical lines on a display portion. It is desired to enable reduction of the time difference.

The TFT liquid crystal display device described in Patent Document 2 has a problem (second problem) that effects of measures against noise are reduced by half.

A reason for the second problem will be described.

The amplifier circuit driving portion outputs the control signals, in the order from the first to the (N/2)th, respectively to the amplifier circuits 236-1 to 236-(N/2) and respectively to the amplifier circuits 236-N to 236-((N/2)+1). In this case, each of the amplifier circuits 236-1 to 236-(N/2) and the corresponding one of the amplifier circuits 236-N to 236-((N/2)+1) operate at the same time. In this case, however, since the amplifier circuits operate two by two at the same timing, the above effects of measures against noise are reduced by half and image quality may be deteriorated. It is desired to enable reduction of noise caused when the amplifier circuits operate at the same timing.

A driver (30) of the present invention includes: multiple amplifier circuits (36-1 to 36-N) for outputting output gradation voltages to a display portion (10) according to control signals; a control circuit (40); and delay portions (41, 42 and 43). The control circuit (40) outputs first control signals (CTR1) as the control signals. The delay portions (41, 42 and 43) sequentially output the first control signals (CTR1) respectively to amplifier circuits in a first amplifier circuit group including half of the multiple amplifier circuits, and sequentially output second control signals (CTR2) obtained by delaying the first control signals (CTR1) by a certain delay time respectively to amplifier circuits in a second amplifier circuit group other than the first amplifier circuit group.

According to the driver (30) of the present invention, the amplifier circuits in the first amplifier circuit group sequentially operate, and the amplifier circuits in the second amplifier circuit group sequentially operate. Moreover, a time required for all the amplifier circuits in the first amplifier circuit group to operate and a time required for all the amplifier circuits in the second amplifier circuit group to operate are half the time required for all the amplifier circuits 136-1 to 136-N described above to operate. Therefore, the reduction in the time prevents abnormal display of vertical lines on the display portion (10). Thus, the first problem is solved.

Moreover, according to the driver (30) of the present invention, the timing when the second amplifier circuit group operates is delayed by a certain delay time from the timing when the first amplifier circuit group operates. In other words, the first and second amplifier circuit groups do not operate at the same timing. Therefore, the operation timings described above reduce noise which would otherwise occur when the amplifier circuits operate at the same timing. Thus, the image quality is not deteriorated. Hence, the second problem is solved.

BRIEF DESCRIPTION OF THE DRAWINGS

The above and other exemplary aspects, advantages and features of the present invention will be more apparent from the following description of certain exemplary embodiments taken in conjunction with the accompanying drawings, in which.

DETAILED DESCRIPTION OF THE EXEMPLARY EMBODIMENTS

Figure 1:
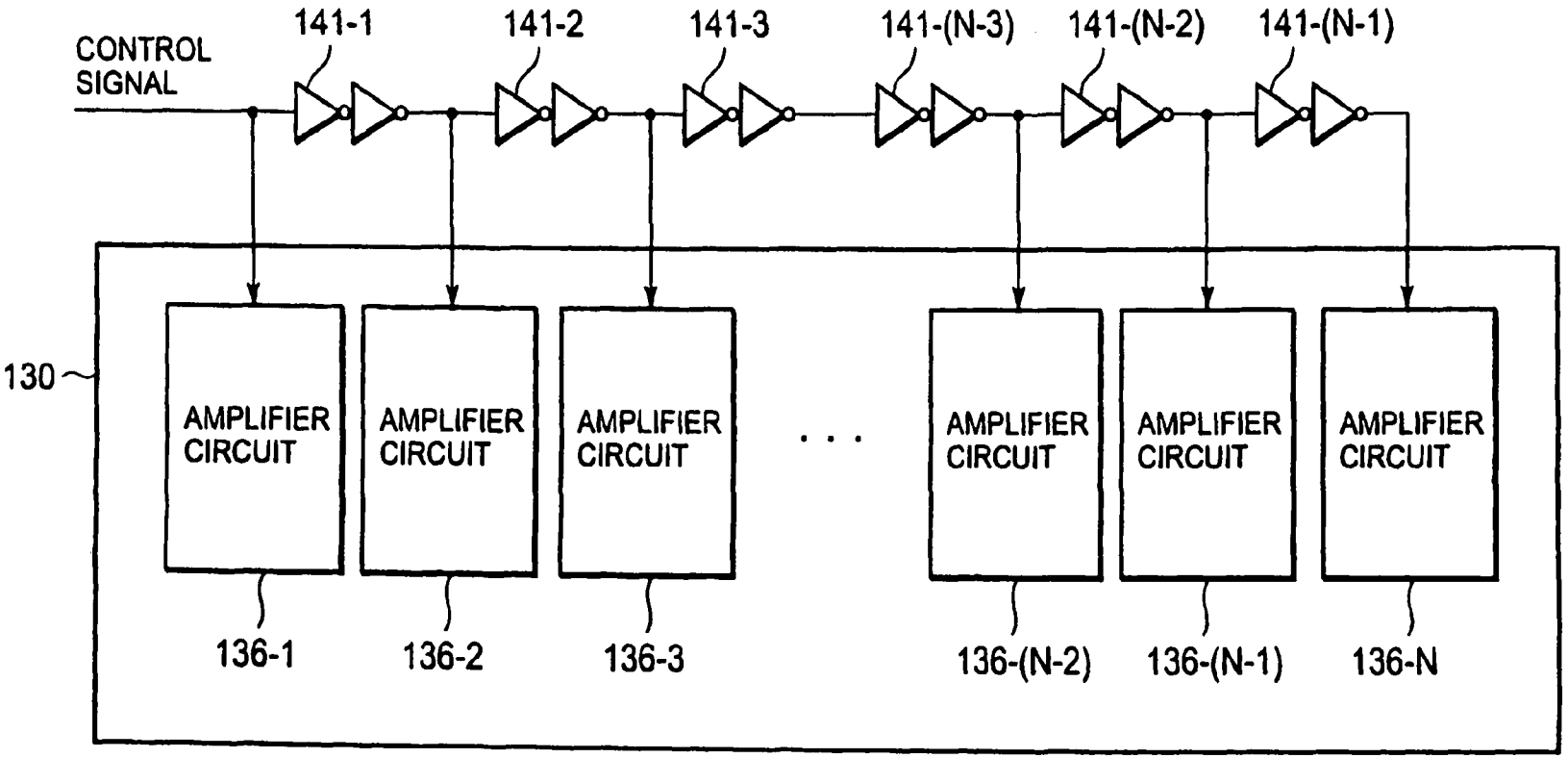
FIG. 1 RELATED ART
FIG. 1 shows a configuration of a source driver in a TFT liquid crystal display device described in Patent Document 1.
Figure 2:
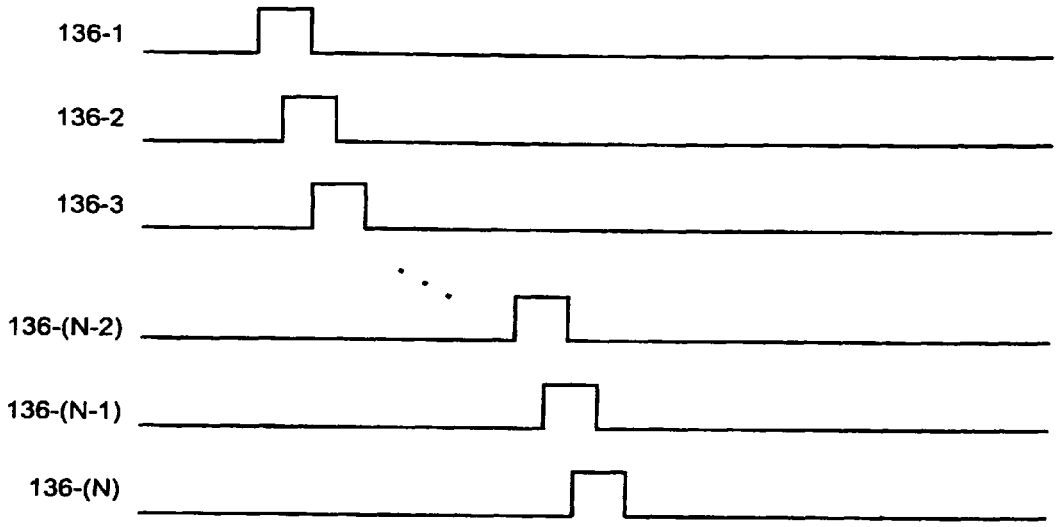
FIG. 2 RELATED ART
FIG. 2 is a timing chart showing an operation of an amplifier circuit driving portion in the source driver shown in FIG. 1.
Figure 3:
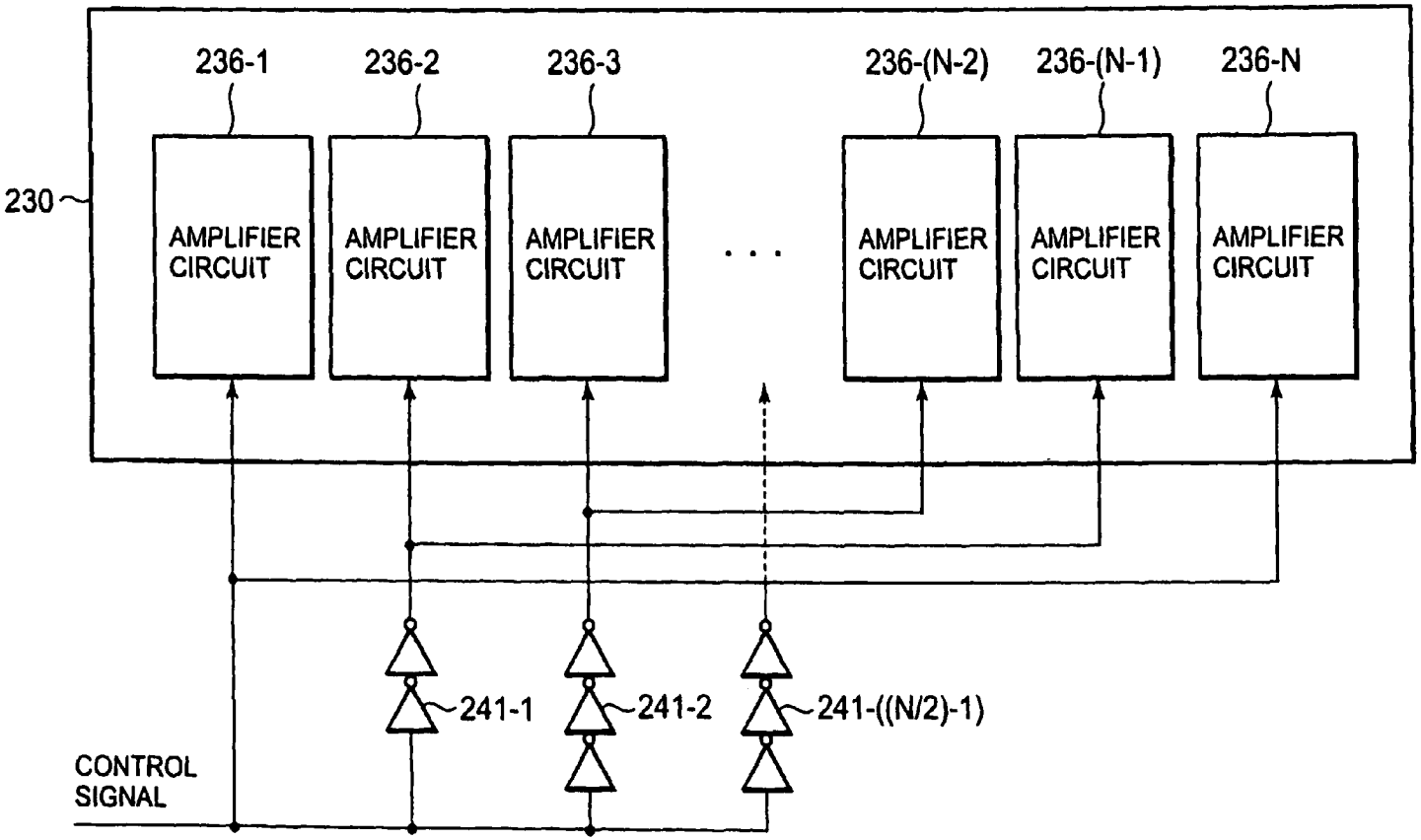
FIG. 3 RELATED ART
FIG. 3 shows a configuration of a source driver in a TFT liquid crystal display device described in Patent Document 2.
Figure 4:
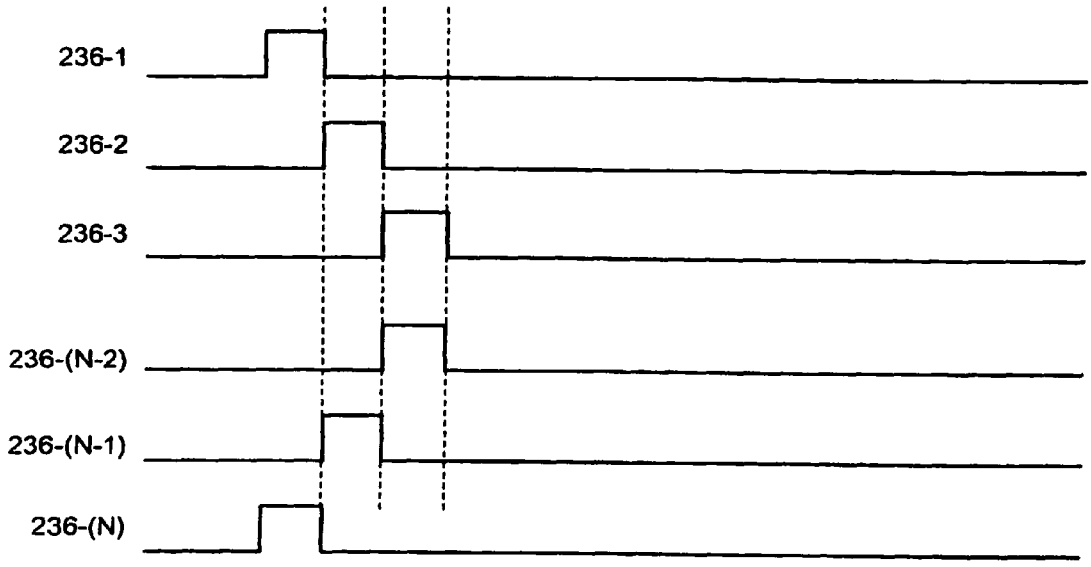
FIG. 4 RELATED ART
FIG. 4 is a timing chart showing an operation of an amplifier circuit driving portion in the source driver shown in FIG. 3.
Figure 5:
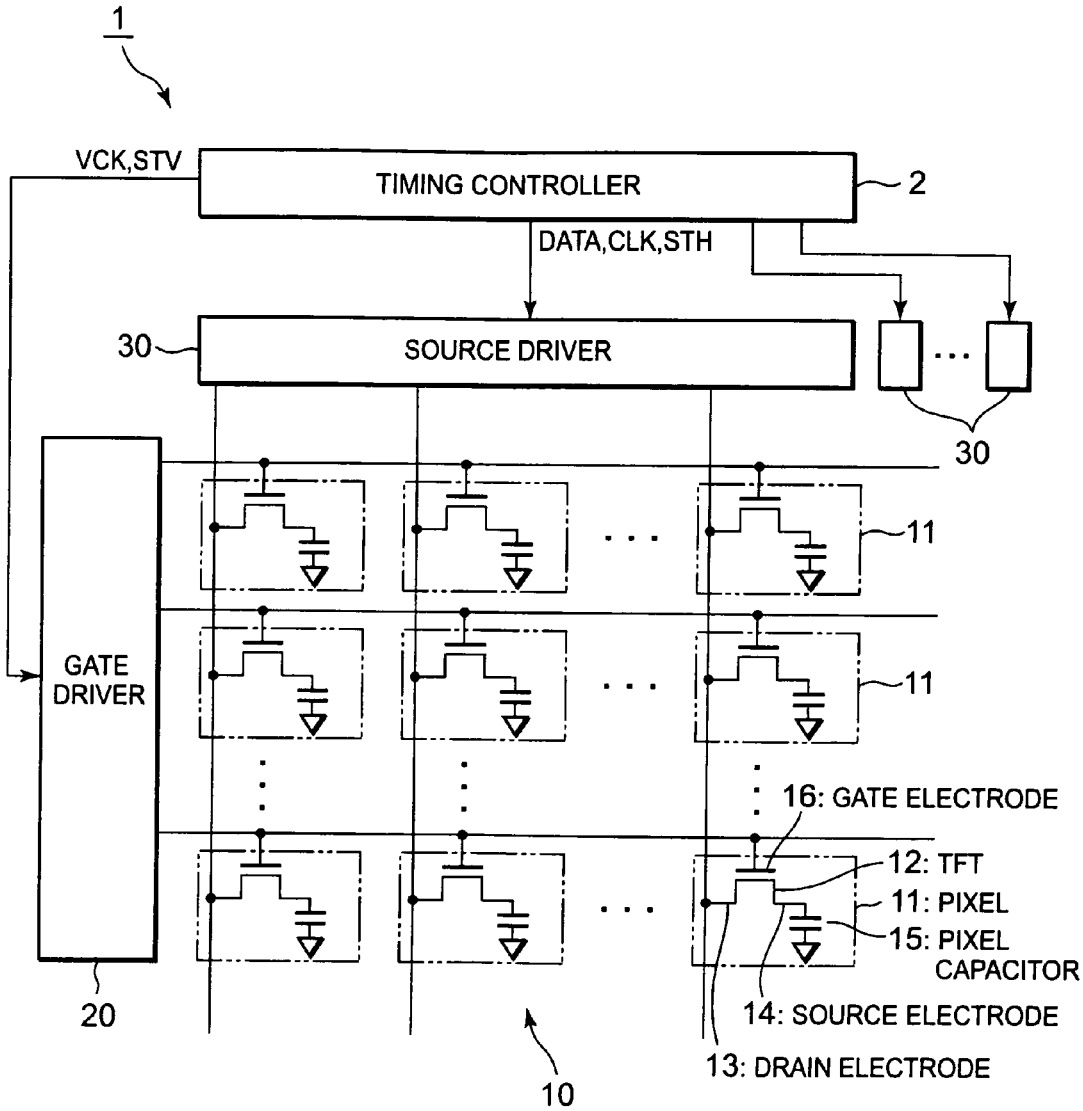
FIG. 5 shows a configuration of a TFT liquid crystal display device 1 according to an exemplary embodiment of the present invention

FIG. 5 shows a configuration of a TFT liquid crystal display device 1 according to an exemplary embodiment of the present invention.

The TFT liquid crystal display device 1 includes a display portion (liquid crystal panel) 10 that is an LCD (Liquid Crystal Display) module. The liquid crystal panel 10 includes multiple pixels 11 arranged in a matrix pattern. Each of the multiple pixels 11 includes a thin film transistor (TFT) 12 and a pixel capacitor 15. The pixel capacitor 15 includes a pixel electrode and an opposite electrode facing the pixel electrode. The TFT 12 includes a drain electrode 13, a source electrode 14 connected to the pixel electrode, and a gate electrode 16.

The TFT liquid crystal display device 1 further includes a gate driver 20 and multiple source drivers 30 as drivers for driving the multiple pixels 11 of the liquid crystal panel 10. The gate driver 20 and the multiple source drivers 30 are provided on a chip (not shown).

The TFT liquid crystal display device 1 further includes multiple gate lines connected to the gate driver 20 and multiple data lines connected to each of the multiple source drivers 30. Each of the multiple gate lines is connected to the gate electrodes 16 of the TFTs 12 in the pixels 11 provided in a row. Each of the multiple data lines is connected to the drain electrodes 13 of the TFTs 12 in the pixels 11 provided in a column.

The TFT liquid crystal display device 1 further includes a timing controller 2. The timing controller 2 is provided on the chip.

The timing controller 2 outputs to the gate driver 20, within one horizontal period, a vertical clock signal VCK and a vertical shift pulse signal STV for sequentially selecting the multiple gate lines from the first to the last. For example, it is assumed that the gate driver 20 selects one gate line out of the multiple gate lines in accordance with the vertical shift pulse signal STV and the vertical clock signal VCK. In this case, a selection signal is outputted to the one gate line. The selection signal is supplied to the gate electrodes 16 of the TFTs 12 in the pixels 11 on one line corresponding to the one gate line, and the TFTs 12 are turned on by the selection signal. The same goes for the other gate lines.

The timing controller 2 outputs display data DATA for one screen (one frame), a clock signal CLK and a shift pulse signal STH to the source driver 30. The display data DATA for one screen contains display data from the first line to the last line. The display data for one line contains multiple pieces of display data corresponding to the multiple data lines, respectively. The source driver 30 outputs the multiple pieces of display data to the multiple data lines respectively according to the shift pulse signal STH and the clock signal CLK. In this event, the TFTs 12 in the pixels 11 corresponding to one gate line out of the multiple gate lines and the multiple data lines are turned on. Accordingly, the multiple pieces of display data are written into the pixel capacitors 15 in the pixels 11, respectively, and are held until next write is performed. Thus, the display data DATA for one line is displayed.

Figure 6:
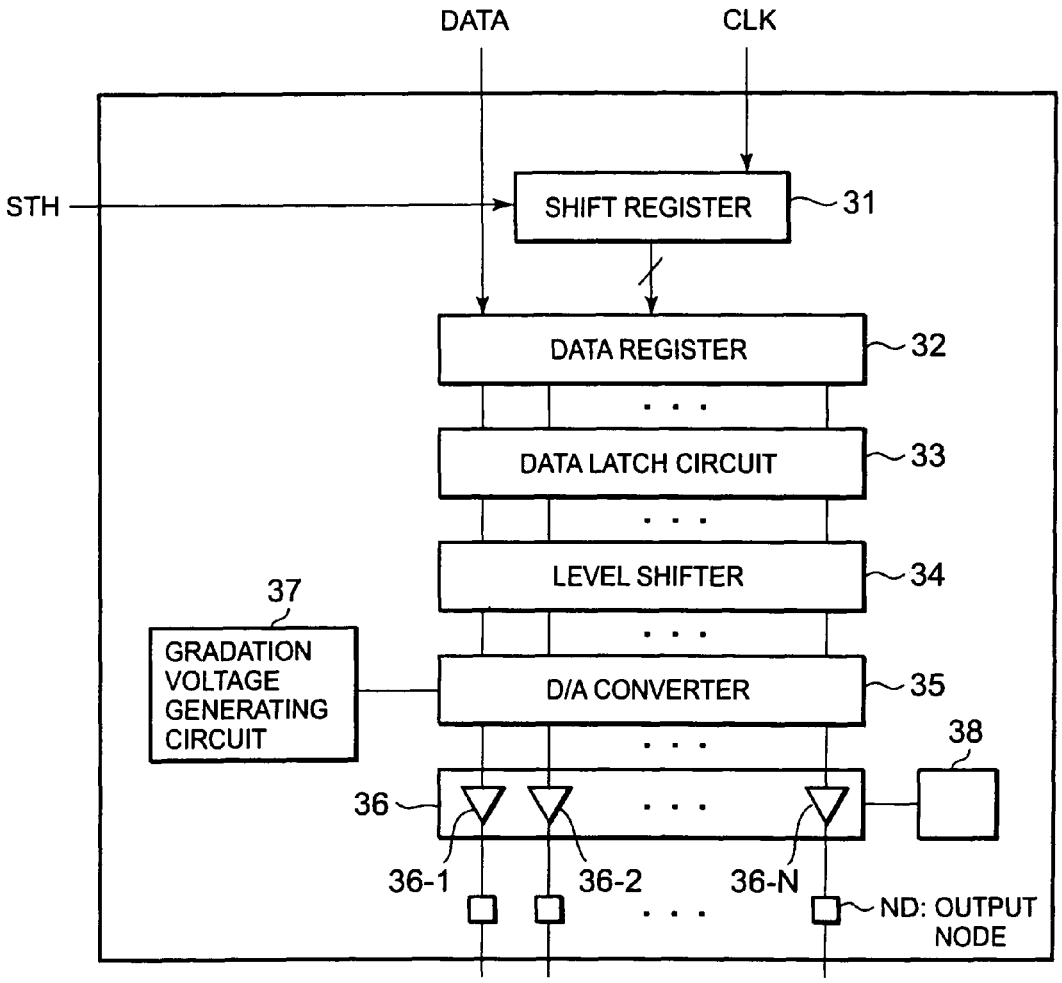
FIG. 6 shows a configuration of a source driver 30 in the TFT liquid crystal display device 1 according to the exemplary embodiment of the present invention.

FIG. 6 shows a configuration of the source driver 30. The source driver 30 includes a shift register 31, a data register 32, a data latch circuit 33, a level shifter 34, a D/A converter 35, an output amplifier 36, a gradation voltage generating circuit 37, an amplifier circuit driving portion 38 and multiple output nodes ND. The multiple output nodes ND are connected to the multiple data lines, respectively. The amplifier circuit driving portion 38 will be described later.

The gradation voltage generating circuit 37 includes gradation resistance elements connected in series. The gradation voltage generating circuit 37 voltage-divides a reference voltage from a power source circuit (not shown) by using the gradation resistance elements and thus generates multiple gradation voltages.

The shift register 31 sequentially shifts the shift pulse signals STH by synchronizing the shift pulse signals STH with the clock signal CLK, and outputs the shift pulse signals STH to the data register 32. The data register 32 latches (loads) the multiple display data from the timing controller 2 in synchronization with the shift pulse signal STH from the shift register 31, and outputs the display data to the data latch circuit 33.

The data latch circuit 33 includes multiple data latch circuits. The multiple data latch circuits latch the multiple pieces of display data respectively at the same timing and output the display data to the level shifter 34.

The level shifter 34 includes multiple level shifters. The multiple level shifters perform level conversion on the multiple pieces of display data from the data latch circuit 33 respectively and output the converted display data to the D/A converter 35.

The D/A converter 35 includes multiple D/A converters. The multiple D/A converters perform digital/analog conversion on the multiple pieces of display data from the level shifter 34 respectively. Specifically, each of the multiple D/A converters selects an output gradation voltage corresponding to the display data from the multiple gradation voltages and outputs the output gradation voltage to the output amplifier 36.

The output amplifier 36 includes multiple amplifier circuits. The multiple amplifier circuits have their outputs connected to the multiple data lines through the multiple output nodes ND, respectively. Moreover, the multiple amplifier circuits operate according to control signals. The multiple amplifier circuits output the output gradation voltages to the multiple data lines according to the control signals, respectively.

Here, it is assumed that the multiple data lines are N data lines provided from the first to Nth in this order, and that the multiple amplifier circuits are N amplifier circuits provided from the first to Nth in this order. It is also assumed that N is an integer of 4 or more and is a multiple of 2. The N amplifier circuits will be hereinafter referred to as amplifier circuits 36-1 to 36-N, respectively.

In order to solve the first and second problems described above, operation timings of the respective multiple amplifier circuits need to be shifted by the control signals.

Figure 7:
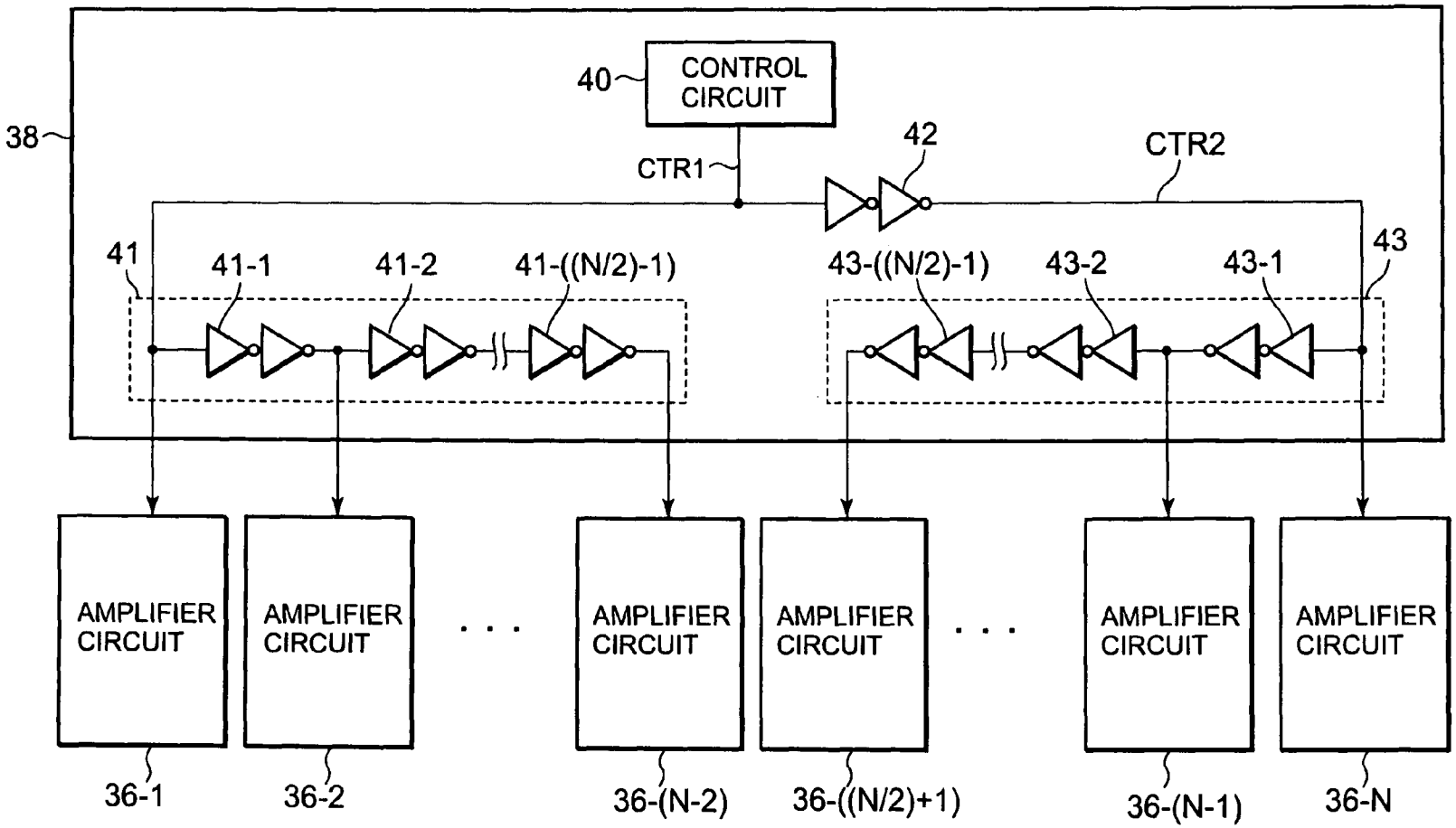
FIG. 7 shows a configuration of an amplifier circuit driving portion 38 in the source driver 30 shown in FIG. 6.

FIG. 7 shows a configuration of the amplifier circuit driving portion 38. The amplifier circuit driving portion 38 includes a control circuit 40 for outputting the control signals and first to third delay portions (delay portions 41 to 43).

The delay portion 41 includes delay circuits 41-1 to 41-((N/2)−1) connected in series. An input of the delay circuit 41-1 is connected to the control circuit 40 and the amplifier circuit 36-1. Outputs of the delay circuits 41-1 to 41-((N/2)−1) are connected to the amplifier circuits 36-2 to 36-(N/2), respectively. Here, the first to (N/2)th amplifier circuits among the amplifier circuits 36-1 to 36-N will be referred to as amplifier circuits 36-1 to 36-(N/2) or a first amplifier circuit group.

The delay portion 42 is a delay circuit (hereinafter referred to as the delay circuit 42) and is connected to the control circuit 40.

The delay portion 43 includes delay circuits 43-1 to 43-((N/2)−1) connected in series. An input of the delay circuit 43-1 is connected to an output of the delay portion 42 and the amplifier circuit 36-N. Outputs of the delay circuits 43-1 to 43-((N/2)−1) are connected to the amplifier circuits 36-(N−1) to 36-((N/2)+1), respectively. Here, the Nth to ((N/2)+1)th amplifier circuits among the amplifier circuits 36-1 to 36-N will be referred to as amplifier circuits 36-N to 36-((N/2)+1) or a second amplifier circuit group.

Figure 8:
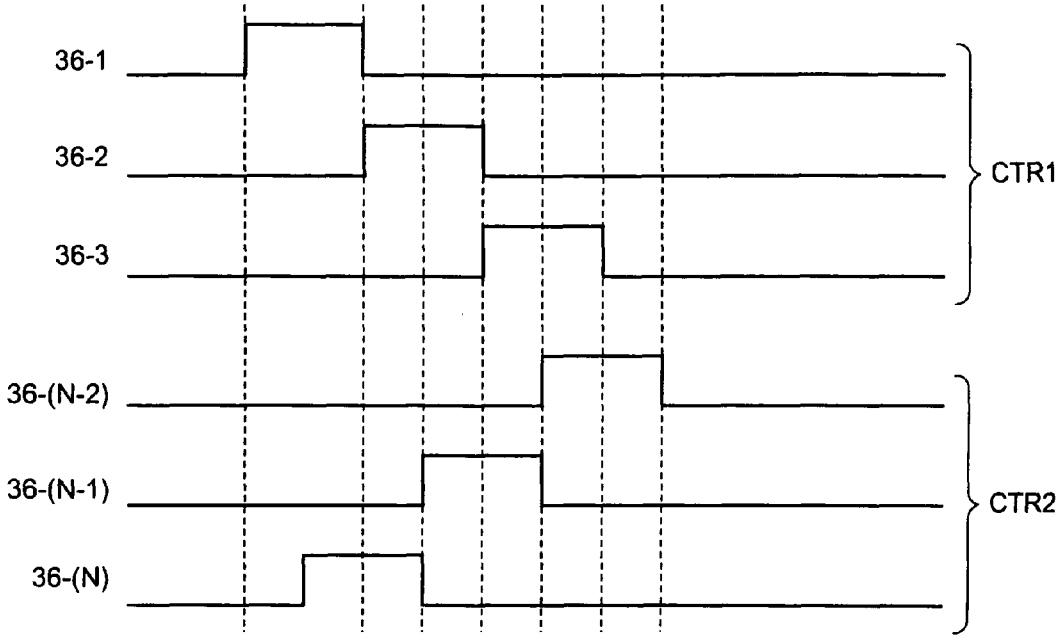
FIG. 8 is a timing chart showing an operation of the amplifier circuit driving portion 38 shown in FIG. 7.

FIG. 8 is a timing chart showing an operation of the amplifier circuit driving portion 38 shown in FIG. 7.

The control circuit 40 outputs a first control signal (hereinafter referred to as a control signal CTR1) as the control signal to the amplifier circuit 36-1. The amplifier circuit 36-1 operates according to the control signal CTR1 from the control circuit 40.

The delay circuits 41-1 to 41-((N/2)−1) delay the control signals CTR1 in the order from the second to the (N/2)th by a first delay time as a certain delay time, and then output the resultant control signals CTR1 to the amplifier circuits 36-2 to 36-(N/2), respectively. For example, the first delay time assumed to be a time for one clock as a certain delay time. The amplifier circuits 36-2 to 36-(N/2) operate according to the control signals CTR1 from the delay circuits 41-1 to 41-((N/2)−1), respectively.

The delay circuit 42 generates a second control signal (hereinafter referred to as a control signal CTR2) by delaying the control signal CTR1 by a second delay time as a certain delay time. The second delay time is assumed to be shorter than the first delay time and to be half the first delay time. The delay portion 42 outputs the control signal CTR2 to the amplifier circuit 36-N. The amplifier circuit 36-N operates according to the control signal CTR2 from the delay circuit 42.

The delay circuits 43-1 to 43-((N/2)−1) delay the control signals CTR2 in the order from the (N−1)th to ((N/2)+1)th by the first delay time, and then output the resultant control signals CTR2 to the amplifier circuits 36-(N−1) to 36-((N/2)+1), respectively. The amplifier circuits 36-(N−1) to 36-((N/2)+1) operate according to the control signals CTR2 from the delay circuits 43-1 to 43-((N/2)−1), respectively.

According to the above description, in the TFT liquid crystal display device 1, the control circuit 40 in the amplifier circuit driving portion 38 outputs the control signals CTR 1 as the control signals. In this event, the delay portions 41 to 43 in the amplifier circuit driving portion 38 sequentially output the control signals CTR1 to the first amplifier circuit group {the respective amplifier circuits 36-1 to 36-(N/2)}, which are half of the amplifier circuits 36-1 to 36-N. Moreover, the delay portions 41 to 43 sequentially output the control signals CTR2 obtained by delaying the control signals CTR1 by the second delay time to the second amplifier circuit group {the respective amplifier circuits 36-N to 36-((N/2)+1)} other than the first amplifier circuit group.

As described above, according to the TFT liquid crystal display device 1, the amplifier circuits 36-1 to 36-(N/2) operate in the order from the first to the (N/2)th, and the amplifier circuits 36-N to 36-((N/2)+1) operate in the order from the Nth to the ((N/2)+1)th. To put it differently, the amplifier circuits 36-1 to 36-N operate from the amplifier circuits at both ends {amplifier circuits 36-1 and 36-N} toward the amplifier circuits in the center {amplifier circuits 36-(N/2) and 36-((N/2)+1)}. Thus, a time difference between a timing when the amplifier circuit 36-1 operates and a timing when the amplifier circuit 36-(N/2) operates and a time difference between a timing when the amplifier circuit 36-N operates and a timing when the amplifier circuit 36-((N/2)+1) operates are reduced to half the time difference between a timing when the amplifier circuit 136-1 operates and a timing when the amplifier circuit 136-N operates. In other words, a time required for all the amplifier circuits 36-1 to 36-(N/2) to operate and a time required for all the amplifier circuits 36-N to 36-((N/2)+1) to operate are half the time required for all the amplifier circuits 136-1 to 136-N to operate. Therefore, the reduction in the time difference prevents abnormal display of vertical lines on the display portion 10. Thus, the first problem is solved.

Moreover, according to the TFT liquid crystal display device 1, the timing when the amplifier circuits 36-N to 36-((N/2)+1) operate is delayed by the second delay time from the timing when the amplifier circuits 36-1 to 36-(N/2) operate. In other words, the amplifier circuits 36-1 to 36-(N/2) and the amplifier circuits 36-N to 36-((N/2)+1) do not operate at the same timing. Therefore, the operation timings described above reduce noise which would otherwise occur when the amplifier circuits operate at the same timing. Thus, image quality is not deteriorated. Hence, the second problem is solved.

Figure 9:
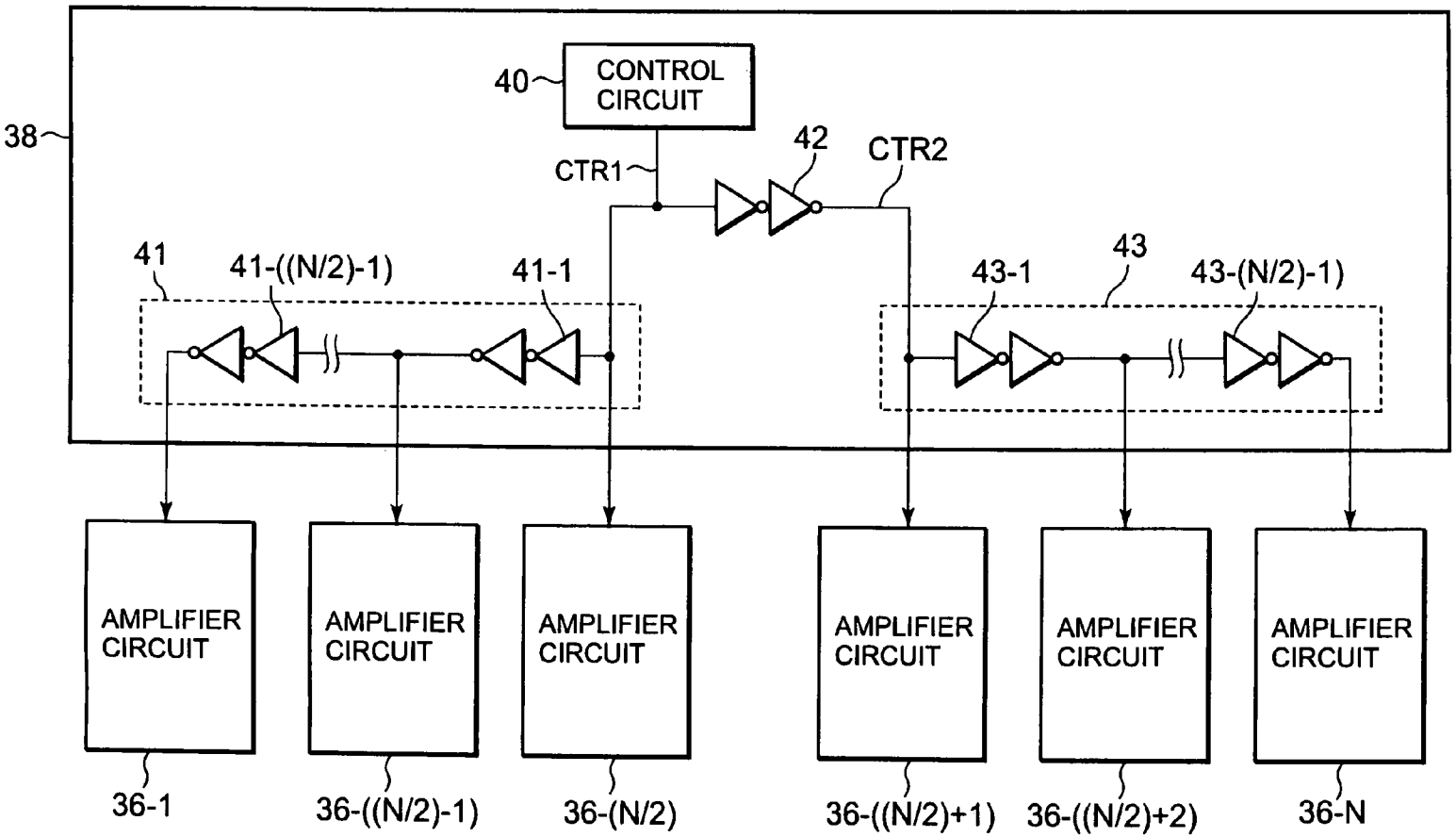
FIG. 9 shows a configuration of the amplifier circuit driving portion 38 in the source driver 30 shown in FIG. 6.

Note that, in the TFT liquid crystal display device 1, as shown in FIG. 9, the control signals may be supplied from the amplifier circuits in the center {amplifier circuits 36-(N/2) and 36-((N/2)+1)} toward the amplifier circuits at the both ends {amplifier circuits 36-1 and 36-N} among the amplifier circuits 36-1 to 36-N.

In this case, the input of the delay circuit 41-1 is connected to the control circuit 40 and the amplifier circuit 36-(N/2). The outputs of the delay circuits 41-1 to 41-((N/2)1) are connected to the amplifier circuits 36-((N/2)1) to 36-1, respectively. Here, the (N/2)th to the first amplifier circuits among the amplifier circuits 36-1 to 36-N will be referred to as amplifier circuits 36-(N/2) to 36-1 or a first amplifier circuit group.

The input of the delay circuit 43-1 is connected to the output of the delay portion 42 and the amplifier circuit 36-((N/2)+1). The outputs of the delay circuits 43-1 to 43-((N/2)−1) are connected to the amplifier circuits 36-((N/2)+2) to 36-N, respectively. Here, the ((N/2)+1)th to Nth amplifier circuits among the amplifier circuits 36-1 to 36-N will be referred to as amplifier circuits 36-((N/2)+1) to 36-N or a second amplifier circuit group.

Figure 10:
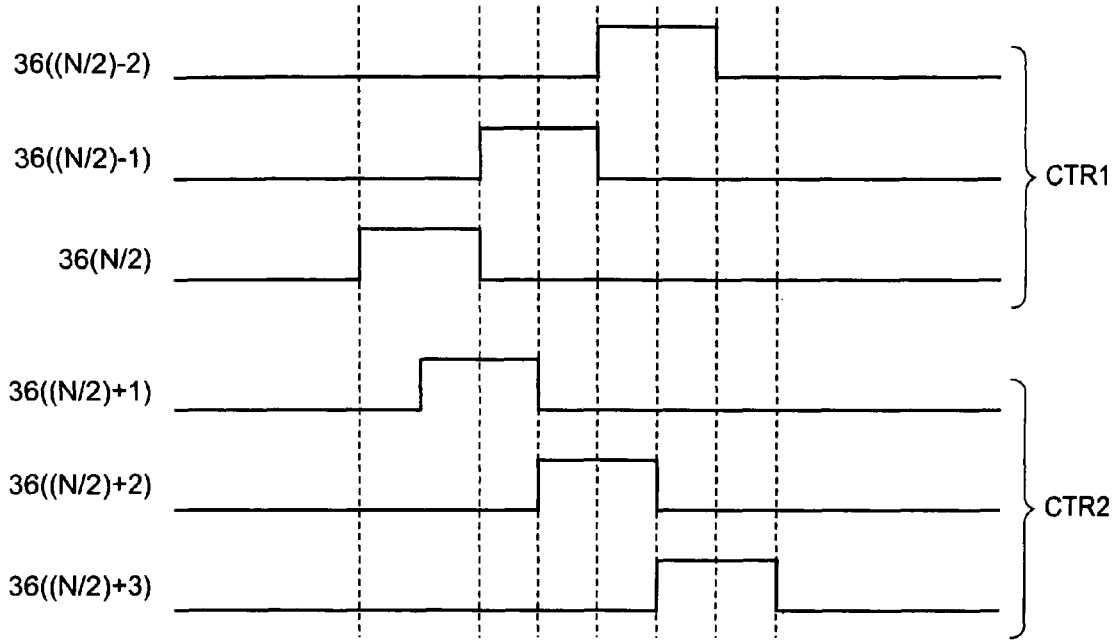
FIG. 10 is a timing chart showing an operation of the amplifier circuit driving portion 38 shown in FIG. 9.

FIG. 10 is a timing chart showing an operation of the amplifier circuit driving portion 38 shown in FIG. 9.

The control circuit 40 outputs a control signal CTR1 as the control signal to the amplifier circuit 36-(N/2). The amplifier circuit 36-(N/2) operates according to the control signal CTR1 from the control circuit 40.

The delay circuits 41-1 to 41-((N/2)−1) delay the control signals CTR1 by the first delay time in the order from the ((N/2)−1)th to the first, and then output the resultant control signals CTR1 to the amplifier circuits 36-((N/2)−1) to 36-1, respectively. The amplifier circuits 36-((N/2)−1) to 36-1 operate according to the control signals CTR1 from the delay circuits 41-1 to 41-((N/2)−1), respectively.

The delay circuit 42 generates a control signal CTR2 by delaying the control signal CTR1 by the second delay time. The delay portion 42 outputs the control signal CTR2 to the amplifier circuit 36-((N/2)+1). The amplifier circuit 36-((N/2)+1) operates according to the control signal CTR2 from the delay circuit 42.

The delay circuits 43-1 to 43-((N/2)−1) delay the control signals CTR2 by the first delay time in the order from the ((N/2)+2)th to Nth, and then output the resultant control signals CTR2 to the amplifier circuits 36-((N/2)+2) to 36-N, respectively. The amplifier circuits 36-((N/2)+2) to 36-N operate according to the control signals CTR2 from the delay circuits 43-1 to 43-((N/2)−1), respectively.

According to the above description, in the TFT liquid crystal display device 1, the control circuit 40 in the amplifier circuit driving portion 38 outputs the control signals CTR1 as the control signals. In this event, the delay portions 41 to 43 in the amplifier circuit driving portion 38 sequentially output the control signals CTR1 to the first amplifier circuit group {the respective amplifier circuits 36-(N/2) to 36-1}, which are half of the amplifier circuits 36-1 to 36-N. Moreover, the delay portions 41 to 43 sequentially output the control signals CTR2 obtained by delaying the control signals CTR1 by the second delay time to the second amplifier circuit group {the respective amplifier circuits 36-((N/2)+1) to 36-N} other than the first amplifier circuit group.

As described above, according to the TFT liquid crystal display device 1, the amplifier circuits 36-(N/2) to 36-1 operate in the order from the (N/2)th to the first, and the amplifier circuits 36-((N/2)+1) to 36-N operate in the order from the ((N/2)+1)th to the Nth. To put it differently, the amplifier circuits 36-1 to 36-N operate from the amplifier circuits in the center {amplifier circuits 36-(N/2) and 36-((N/2)+1)} toward the amplifier circuits at both ends {amplifier circuits 36-1 and 36-N}. Thus, a time difference between a timing when the amplifier circuit 36-(N/2) operates and a timing when the amplifier circuit 36-1 operates and a time difference between a timing when the amplifier circuit 36-((N/2)+1) operates and a timing when the amplifier circuit 36-N operates are reduced to half the above-mentioned time difference between a timing when the amplifier circuit 136-1 operates and a timing when the amplifier circuit 136-N operates. In other words, a time required for all the amplifier circuits 36-(N/2) to 36-1 to operate and a time required for all the amplifier circuits 36-((N/2)+1) to 36-N to operate are half the time required for all the amplifier circuits 136-1 to 136-N described above to operate. Therefore, the reduction in the time difference prevents abnormal display of vertical lines on the display portion 10. Thus, the first problem is solved.

Moreover, according to the TFT liquid crystal display device 1, the timing when the amplifier circuits 36-((N/2)+1) to 36-N operate is delayed by the second delay time from the timing when the amplifier circuits 36-(N/2) to 36-1 operate. In other words, the amplifier circuits 36-(N/2) to 36-1 and the amplifier circuits 36-((N/2)+1) to 36-N do not operate at the same timing. Therefore, the operation timings reduce noise which would otherwise occur when the amplifier circuits operate at the same timing. Thus, image quality is not deteriorated. Hence, the second problem is solved.

It is noted that the present invention includes an amplifier circuit driving method applied to a driver including a plurality of amplifier circuits for outputting output gradation voltages to a display portion according to control signals, the method comprising:

(a) outputting first control signals as the control signals;

(b) sequentially outputting the first control signals respectively to amplifier circuits in a first amplifier circuit group including half of the plurality of amplifier circuits;

(c) generating second control signals by delaying the first control signals by a certain delay time; and (d) sequentially outputting the second control signals respectively to amplifier circuits in a second amplifier circuit group other than the first amplifier circuit group.

When the plurality of amplifier circuits are N amplifier circuits provided in order from a first to an Nth (where N is an integer of 4 or more and is a multiple of 2), the first amplifier circuit group includes the first to (N/2)th amplifier circuits, the second amplifier circuit group includes the Nth to ((N/2)+1)th amplifier circuits, in the step (a), one of the first control signals is outputted to the first amplifier circuit, in the step (b), the first control signals are delayed by a first delay time in order from a second to a (N/2)th, and the resultant first control signals are outputted to the second to (N/2)th amplifier circuits, respectively, in the step (c), the second control signal obtained by delaying the one of the first control signals by a second delay time as the delay time is outputted to the Nth amplifier circuit, and in the step (d), the second control signals are delayed by the first delay time in order from a (N−1)th to a ((N/2)+1)th, and the resultant second control signals are outputted to the (N−1)th to ((N/2)+1)th amplifier circuits, respectively.

When the plurality of amplifier circuits are N amplifier circuits provided in order from a first to an Nth (where N is an integer of 4 or more and is a multiple of 2), the first amplifier circuit group includes the (N/2)th to first amplifier circuits, the second amplifier circuit group includes the ((N/2)+1)th to Nth amplifier circuits, in the step (a), one of the first control signals is outputted to the (N/2)th amplifier circuit, in the step (b), the first control signals are delayed by a first delay time in order from a ((N/2)−1)th to a first, and the resultant first control signals are outputted to the ((N/2)−1)th to first amplifier circuits, respectively, in the step (c), the second control signal obtained by delaying the one of the first control signals by a second delay time as the delay time is outputted to the ((N/2)+1)th amplifier circuit, and in the step (d), the second control signals are delayed by the first delay time in order from a ((N/2)+2)th to an Nth, and the resultant second control signals are outputted to the ((N/2)+2)th to Nth amplifier circuits, respectively.

The second delay time is shorter than the first delay time.

It is noted that the number of amplifier circuits in the first and second amplifier groups may be half of the multiple amplifier circuits or approximately half or some other predetermined amount which would lead to achieving the advantages of the present invention over the related techniques and structures.

Further, it is noted that Applicant's intent is to encompass equivalents of all claim elements, even if amended later during prosecution.

What is claimed is:

1. A driver, comprising:

a plurality of amplifier circuits which outputs a plurality of gradation voltages to a display portion according to a control signal;

a control circuit which outputs the control signal; and a delay portion which sequentially supplies the control signal to amplifier circuits in a first amplifier circuit group including half of the plurality of amplifier circuits, and which sequentially supplies a delayed control signal to amplifier circuits in a second amplifier circuit group other than the first amplifier circuit group, the delayed control signal being obtained by delaying the control signal by a certain delay time, wherein, when the plurality of amplifier circuits are N amplifier circuits provided in order from a first amplifier circuit to an Nth amplifier circuit (where N is an integer of 4 or more and is a multiple of 2), the first amplifier circuit group includes the first amplifier circuit to an (N/2)th amplifier circuit, the second amplifier circuit group includes the Nth amplifier circuit to an ((N/2)+1)th amplifier circuit, the control circuit outputs the control signal to the first amplifier circuit, and the delay portion includes:

a first delay portion which delays the control signal by a first delay time in order from a second amplifier circuit to the (N/2)th amplifier circuit, to supply the control signal to the second amplifier circuit to the (N/2)th amplifier circuit;

a second delay portion which delays the control signal by a second delay time to produce the delayed control signal to supply the delayed control signal to the Nth amplifier circuit; and a third delay portion which delays the delayed control signal by the first delay time in order from an (N−1)th amplifier circuit to the ((N/2)+1)th amplifier circuit, to supply the delayed control signal to the (N−1)th amplifier circuit to the ((N/2)+1)th amplifier circuit, and wherein the second delay time is shorter than the first delay time.

2. A driver, comprising:

a plurality of amplifier circuits which outputs a plurality of gradation voltages to a display portion according to a control signal;

a control circuit which outputs the control signal; and a delay portion which sequentially supplies the control signal to amplifier circuits in a first amplifier circuit group including half of the plurality of amplifier circuits, and which sequentially supplies a delayed control signal to amplifier circuits in a second amplifier circuit group other than the first amplifier circuit group, the delayed control signal being obtained by delaying the control signal by a certain delay time, wherein, when the plurality of amplifier circuits are N amplifier circuits provided in order from a first amplifier circuit to an Nth amplifier circuit (where N is an integer of 4 or more and is a multiple of 2), the first amplifier circuit group includes an (N/2)th amplifier circuit to the first amplifier circuit, the second amplifier circuit group includes an ((N/2)+1)th amplifier circuit to the Nth amplifier circuit, the control circuit outputs the control signals to the (N/2)th amplifier circuit, and the delay portion includes:

a first delay portion which delays the control signal by a first delay time in order from an ((N/2)−1)th amplifier circuit to the first amplifier circuit, to supply the control signal to the ((N/2)−1)th amplifier circuit to first amplifier circuit;

a second delay portion which delays the control signal by a second delay time to produce the delayed control signal to supply the delayed control signal to the ((N/2)+1)th amplifier circuit; and a third delay portion which delays the delayed control signal by the first delay time in order from an ((N/2)+2)th amplifier circuit to the Nth amplifier circuit, to supply the delayed control signal to the ((N/2)+2)th amplifier circuit to the Nth amplifier circuit, and wherein the second delay time is shorter than the first delay time.

3. A display device, comprising:

a display portion;

a driver connected to the display portion through data lines;

a plurality of amplifier circuits which outputs a plurality of gradation voltages to the display portion according to a control signal;

a control circuit which outputs the control signal; and a delay portion which sequentially supplies the control signal to amplifier circuits in a first amplifier circuit group including half of the plurality of amplifier circuits, and which sequentially supplies a delayed control signal to amplifier circuits in a second amplifier circuit group other than the first amplifier circuit group, the delayed control signal being obtained by delaying the control signal by a certain delay time, wherein, when the plurality of amplifier circuits are N amplifier circuits provided in order from a first amplifier circuit to an Nth amplifier circuit (where N is an integer of 4 or more and is a multiple of 2), the first amplifier circuit group includes the first amplifier circuit to an (N/2)th amplifier circuit, the second amplifier circuit group includes the Nth amplifier circuit to an ((N/2)+1)th amplifier circuit, the control circuit outputs the control signal to the first amplifier circuit, and the delay portion includes:

a first delay portion which delays the control signal by a first delay time in order from a second amplifier circuit to the (N/2)th amplifier circuit, to supply the control signal to the second amplifier circuit to the (N/2)th amplifier circuit;

a second delay portion which delays the control signal by a second delay time to produce the delayed control signal to supply the delayed control signal to the Nth amplifier circuit; and a third delay portion which delaying the delayed control signal by the first delay time in order from an (N−1)th amplifier circuit to the(N/2)+1)th amplifier circuit, and to supply the delayed control signal to the (N−1) th amplifier circuit to the ((N/2)+1)th amplifier circuit, and wherein the second delay time is shorter than the first delay time.

4. A display device, comprising:

a display portion;

a driver connected to the display portion through data lines;

a plurality of amplifier circuits which outputs a plurality of gradation voltages to the display portion according to a control signal;

a control circuit which outputs the control signal; and a delay portion which sequentially supplies the control signal to amplifier circuits in a first amplifier circuit group including half of the plurality of amplifier circuits, and which sequentially supplies a delayed control signal to amplifier circuits in a second amplifier circuit group other than the first amplifier circuit group, the delayed control signal being obtained by delaying the control signal by a certain delay time, wherein, when the plurality of amplifier circuits are N amplifier circuits provided in order from a first amplifier circuit to an Nth amplifier circuit (where N is an integer of 4 or more and is a multiple of 2), the first amplifier circuit group includes an (N/2)th amplifier circuit to the first amplifier circuit, the second amplifier circuit group includes an ((N/2)+1)th amplifier circuit to the Nth amplifier circuit, the control circuit outputs the control signals to the (N/2)th amplifier circuit, and the delay portion includes:

a first delay portion which delays the control signal by a first delay time in order from the ((N/2)−1)th amplifier circuit to the first amplifier circuit, to supply the control signal to the ((N/2)−1)th amplifier circuit to first amplifier circuit;

a second delay portion which delays the control signal by a second delay time to produce the delayed control signal to supply the delayed control signal to the ((N/2)+1)th amplifier circuit; and a third delay portion which delays the delayed control signal by the first delay time in order from an ((N/2)+2)th amplifier circuit to the Nth amplifier circuit, to supply the delayed control signal to the ((N/2)+2)th amplifier circuit to Nth amplifier circuit, and wherein the second delay time is shorter than the first delay time.

5. A display driver, comprising:

a control circuit which outputs a control signal;

a delay circuit which produces a first delay signal by delaying the control signal by a first delay period;

a first delay chain including a plurality of first delay circuits connected in series to each other, each of the first delay circuits having a second delay period, the first delay chain receiving the control signal and producing a plurality of first control signals generated by the first delay circuits;

a second delay chain including a plurality of second delay circuits connected in series to each other, each of the second delay circuits having a third delay period, the second delay chain receiving the first delay signal and producing a plurality of second control signals generated by the second delay circuits;

a first group of amplifier circuits connected to the first delay chain to receive at least the first control signals; and a second group of amplifier circuits connected to the second delay chain to receive at least the second control signals, wherein the control circuit, the delay circuit, the first delay chain and the second delay chain are provided in an amplifier circuit driving unit constructed in a rectangular shape including a long side and a short side, wherein the control circuit is arranged at almost a center portion of the amplifier circuit driving unit at the long side, wherein the first group of amplifier circuits is arranged to transfer the control signal from the center portion toward a first edge of the amplifier circuit driving unit in the long side, wherein the second group of amplifier circuits is arranged to transfer the first delay signal from the center portion toward a second edge of the amplifier circuit driving unit in the long side, and wherein the first delay period is shorter than the second delay period.

6. The display driver according to claim 5, wherein the second delay chain is connected to the delay circuit without intervening the first delay chain.

7. The display driver according to claim 5, wherein the third delay period comprises a same delay period as the second delay period.

* * * * *